United States Patent [19]

Jackson

[11] 4,088,080

[45] May 9, 1978

[54] RAILWAY LOCOMOTIVE TRUCK

[75] Inventor: Keith L. Jackson, Granite City, Ill.

[73] Assignee: General Steel Industries, Inc., St. Louis, Mo.

[21] Appl. No.: 708,722

[22] Filed: Jul. 26, 1976

[51] Int. Cl.[2] ..... B61C 3/00; B61F 3/06; B61F 5/06; B61F 5/16

[52] U.S. Cl. ..... 105/136; 105/196; 105/199 R

[58] Field of Search ..... 105/133, 135, 136, 138, 105/182 R, 196, 199 F, 199 R

[56] References Cited

U.S. PATENT DOCUMENTS

| | | | |
|---|---|---|---|
| 2,371,621 | 3/1945 | Harwick | 105/133 |
| 2,705,924 | 4/1955 | Travilla et al. | 105/196 X |
| 2,741,996 | 4/1956 | Kolesa | 105/196 |
| 2,821,149 | 1/1958 | Travilla | 105/196 |
| 3,014,435 | 12/1961 | Travilla et al. | 105/196 X |
| 3,288,083 | 11/1966 | Jones | 105/34 R |
| 3,387,569 | 6/1968 | Lich | 105/196 |
| 3,547,046 | 12/1970 | Lich | 105/136 X |
| 3,693,553 | 9/1972 | Lich | 105/199 F X |
| 3,796,166 | 3/1974 | Wilmot | 105/199 R |
| 4,040,360 | 8/1977 | Jackson | 105/136 |
| 4,040,361 | 8/1977 | Jackson | 105/136 |
| 4,043,272 | 8/1977 | Jones et al. | 105/136 |

*Primary Examiner*—Drayton E. Hoffman
*Assistant Examiner*—Howard Beltran
*Attorney, Agent, or Firm*—F. Travers Burgess

[57] ABSTRACT

A six-wheel railway motor truck for swivelly supporting a locomotive body is connected to the same for the effective transmission thereto of draft and braking forces at a level at or near that of the rail whereby the vertical moment arm through which traction forces might act to tip the truck frame and thereby cause load transference from axle to axle is minimized, with corresponding minimization of such load transference. The truck comprises a rigid frame resiliently supported on the three axles, a body support bolster supported on the sides of the truck frame by upright springs and held against swivelling movements or longitudinal movements with respect to the truck frame while being free for limited vertical and transverse movements with respect to the truck frame. Transversely and longitudinally spaced sliding bearings on the bolster slidably engage opposing bearings on the locomotive underframe for holding the bolster against tipping longitudinally or transversely with respect to the underframe and cooperating vertical axis pivot-forming bearings on the underframe and bolster transmit longitudinal forces from the bolster to the underframe and permit swivel of the entire truck with respect to the underframe. For transmitting longitudinal forces from the truck frame to the bolster and hence to the supported longitudinal body substantially at rail level, the truck frame is connected to the bolster at each side by a pair of longitudinally upwardly and outwardly inclined links arranged so that their axial projections intersect at track level.

10 Claims, 4 Drawing Figures

RAILWAY LOCOMOTIVE TRUCK

BACKGROUND OF THE INVENTION

1. Field of the Invention

The invention relates to railway rolling stock and consists particularly in a three axle motor truck having a spring-supported bolster swivelly supporting a longitudinal body and connected to the truck frame in such a way that load transference from axle to axle is minimized.

2. The Prior Art

The closest prior art to the present invention is the two-axle truck disclosed in Richard L. Lich U.S. Pat. No. 3,547,046, in which a bolster comprising a transversely extending single beam is swivelly mounted on a single low level frame, the opposite ends of the bolster having draft connections to the locomotive underframe comprising longitudinally upwardly and outwardly inclined links arranged such that their axial projections intersect at track level below the bolster. The bolster supports the locomotive underframe by upright coil springs at its ends, which necessitates the low location of the bolster mounting center transom. This arrangement is satisfactory in a two-axle truck but if a third intermediate axle were added to the truck the low level center transom would make it impossible to suitably mount a motor to drive the middle axle.

REFERENCE TO RELATED APPLICATIONS

My co-pending applications, Ser. No. 658,341, filed Feb. 17, 1976, now U.S. Pat. No. 4,040,360 and Ser. No. 683,923, filed May 6, 1976, now U.S. Pat. No. 4,040,361 are directed to three axle three-motor trucks in which the bolster is supported on the truck frame for swivel about a vertical axis and is arranged to support the locomotive underframe by upright springs and is connected to the locomotive underframe to transmit traction forces thereto by means of longitudinally upwardly and outwardly inclined links, the projections of which intersect at track level.

SUMMARY OF THE INVENTION

A principal objective of the invention is to provide a six-wheel, three-axle railway locomotive truck in which each of the axles has a motor drivingly associated with it and in which the bolster is spring-supported on the truck frame and swivelly supports the locomotive body and is connected to the truck frame by longitudinally upwardly and outwardly inclined traction links, the axes of which converge at rail level in the region of the middle axle, and in which the truck frame and cooperating portions of the bolster are arranged to provide adequate clearance for the middle axle motor and gear box without any substantial increase in the overall height of the truck.

A more detailed objective of the invention is to form the truck frame with a pair of spaced transoms fore and aft respectively of the middle axle to provide transverse connections between the truck frame side members and separate reaction connections for the middle and one end axle traction motors, and to form the bolster with its central portion open and its ends spaced substantially the same distance apart as the transoms, with a shallow longitudinal central tie member connecting the bolster end members and spaced vertically from the middle axle motor and mounting at its center the swivel bearing.

A further object is to provide, in this truck, an arrangement for transmitting body load from the body to the truck bolster at points spaced apart transversely and longitudinally of the truck and to accommodate swivel of the entire truck relative to the locomotive body at a point above the middle axle while providing adequate clearance of all bolster parts above the middle axle motor to accommodate maximum deflections of the bolster support springs.

Figure 1:
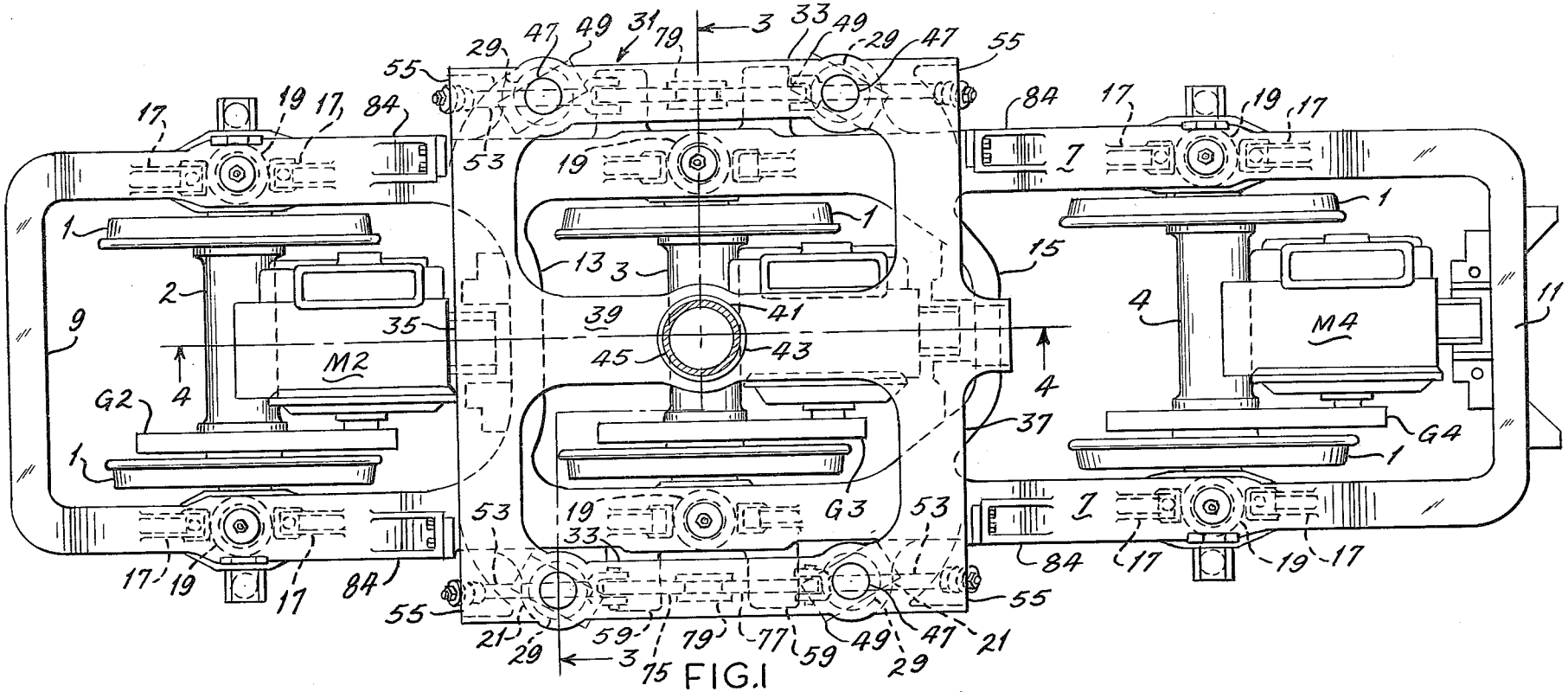
FIG. 1 is a plan view of a truck embodying the invention.
Figure 2:
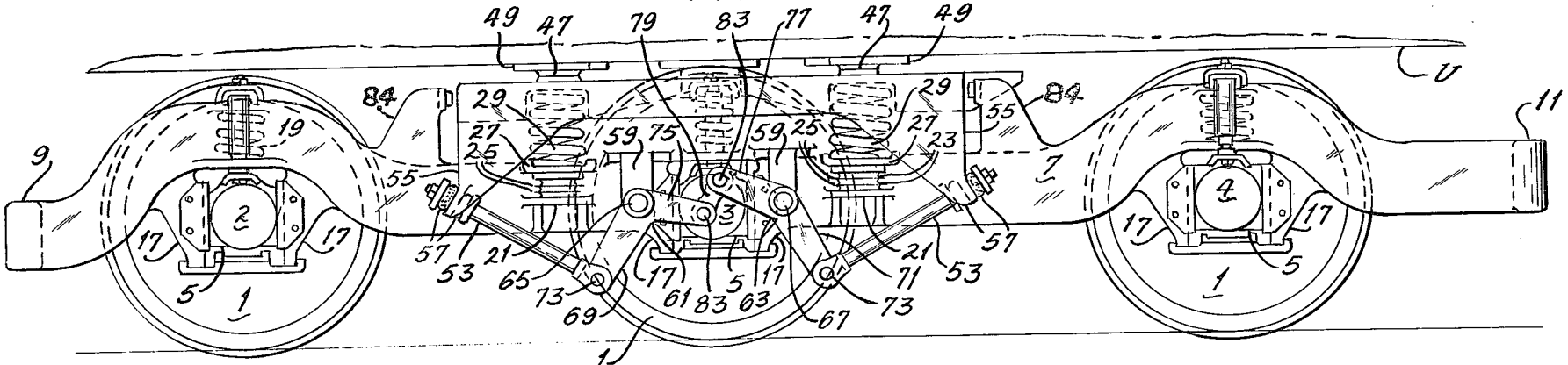
FIG. 2 is a side elevational view of the truck illustrated in FIG. 1 showing adjacent portions of the locomotive underframe.
Figure 3:
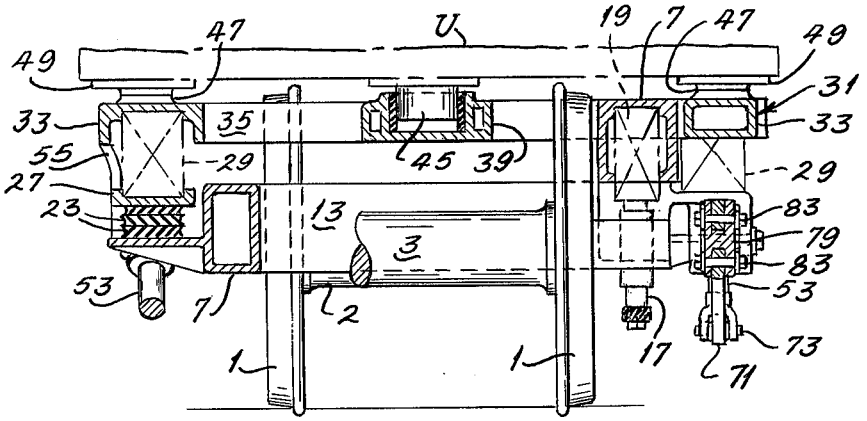
FIG. 3 is a transverse vertical sectional view taken along line 3—3 of FIG. 1.
Figure 4:
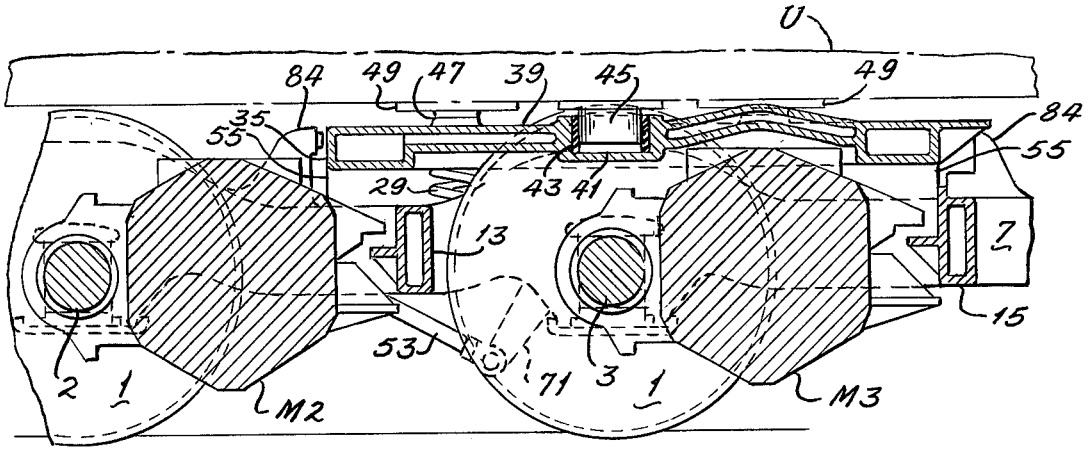
FIG. 4 is a longitudinal vertical sectional view taken along line 4—4 of FIG. 1.

The numeral 1 indicates railway flanged wheels mounted in gauged pairs on spaced axles 2, 3 and 4, axles 2 and 4 being end axles and axle 3 being a middle axle. At their ends, outboard of wheels 1, axles 2, 3 and 4 are rotatably received within journal boxes 5.

A rigid truck frame, preferably of one piece cast steel construction, comprises transversely spaced longitudinally extending side members 7 positioned transversely outboard of wheels 1 and rigidly connected to each other at their ends by transversely extending end transoms 9 and 11 and, between end axle 2 and middle axle 3 by intermediate transom 13, and between middle axle 3 and end axle 4 by intermediate transom 15.

Frame side members are vertically apertured adjacent journal boxes 5 to form pedestal jaws 17 and journal boxes 5 are vertically slidably received in the respective jaws 17 so as to maintain axles 2, 3 and 4 transverse of the truck frame. Coil spring units 19 are supported on top of journal boxes 5 and resiliently support frame side members 7 to cushion the frame from impacts imparted to the wheels by the track structure. For driving the truck, traction motors M2, M3 and M4 are journaled respectively on axles 2, 3 and 4 with their noses extending in the same direction lengthwise of the truck from their respective axles and having reaction connections respectively to intermediate transoms 13 and 15 and end transom 11.

Gear boxes G2, G3 and G4 drivingly connect the respective motors M2, M3 and M4 to axles 2, 3 and 4.

For supporting the body underframe U on the truck frame and permitting vertical and transverse cushioning movements as well as swivel movements therebetween, the truck frame is formed with outboard spring brackets 21 on each side member 7 spaced apart from each other longitudinally of the truck and positioned symetrically longitudinally thereof with respect to the middle axle pedestal jaws 17. An elastomeric lateral motion device comprising a pair of elastomeric pads 23 bonded by and interleaved by metal plates 25 is seated on each bracket 21 and supports an upwardly facing spring seat 27 on which is seated an upright metal coil spring 29.

A bolster generally indicated at 31 comprises longitudinally extending side members 33 carried by springs 29 and connected at their ends respectively by transverse end members 35 and 37 which in turn respectively overlie, at least in part, truck frame transoms 13 and 15. For transmitting longitudinal forces from the bolster to the body underframe, bolster end members 35 and 37 are connected to each other by longitudinally extending tie member 39 which is formed at its center, substantially above middle axle 3, with an upwardly open cylindrical recess 41, in which is fitted a cylindrical sleeve 43 and into which depends, from underframe U, a circular boss 45, which is slidably received in recess 41 to accommodate swivel movements of the bolster and truck relative to the underframe and transmit longitudinal forces from the truck to the underframe. Longitudinal tie member 39 may be slightly arched as at 40 between recess 41 and cross member 37 to provide sufficient vertical clearance above middle axle motor M3 to accommodate maximum deflections of the bolster support springs 29.

For stably supporting the bolster against tipping about a transverse axis with respect to the underframe, the bolster is provided with four upwardly facing bearing surfaces 47 positioned respectively in longitudinally spaced pairs on bolsters side members 33, preferably directly above springs 29, and underframe U is formed with downwardly facing bearing surfaces 49 in sliding engagement with upwardly facing surfaces 47 and elongated respectively in directions normal to radii from the center of boss 45 to each of the upwardly facing bearing surfaces 47 on the bolster. From the foregoing, it will be evident that the bolster is free to swivel about the vertical axis of the cooperating bolster recess 41 and underframe boss 45 but is held against tipping about transverse or longitudinal horizontal axes by the sliding engagement of opposed bearing surfaces 47 and 49.

For transmitting longitudinal forces from the truck to underframe U as close as possible to rail level and thereby minimizing any vertical moment arm through which tractive forces generated between the wheels and rail surfaces would act to transfer load from axle to axle, each truck frame side member 7 is connected to the corresponding bolster side member 33 by longitudinally outwardly and upwardly directed traction transmission links 53, the axial projections of which converge at rail level. Since the bolster is vertically rigid and longitudinally fixed (by mating pivot bearings 41, 45) with respect to underframe U as described above, insofar as the transmission of longitudinal forces from the truck to the underframe through links 53 is concerned, the bolster functions as part of the underframe, and the tractive and braking forces are transmitted in effect, at rail level, from the truck to the underframe.

The connection of links 53 to bolster side members 33 includes depending and longitudinally outwardly extending integral brackets 55 on each bolster side member 33 and resilient pads 57 to accommodate angling of links 53 with respect to brackets 77 necessitated by vertical and transverse movements of bolster 31 with respect to the truck frame.

In order to avoid interference by links 53 with the operation of bolster support springs 29, truck frame side members 7 are formed with depending brackets 59 positioned symmetrically fore and aft of the middle axle pedestal jaw and the connection of links 53 to each truck frame side member 7 comprises a device consisting of a pair of bell cranks 61 and 63 fulcrummed on transverse axes defined by pivot pins 65 and 67 on brackets 59 and having substantially upright arms 69 and 71 pivotally connected at their lower ends respectively at 73 to links 53. Pivotal connections 73 of links 53 to bell crank arms 69 and 71 respectively are constructed to permit universal pivotal movements of links 53 with respect to the respective bell crank arms so as to accommodate vertical and transverse moments of bolster 31 relative to the truck frame. The bell cranks have substantially horizontal arms 75 and 77 respectively extending longitudinally of the truck toward each other with their terminals vertically disposed with respect to each other and a short substantially vertical link 79 is pivotally connected at its respective ends by pins 81 and 83 to arms 75 and 77.

It will be evident that as bolster 31 moves vertically and transversely with respect to the truck frame through deflection of springs 29 and shear in elastomeric pads 23, that bell cranks 61 and 63 are pivoted about their respective fulcrums 65 and 67 equal distances in opposite rotational directions and will accommodate such movements while maintaining track lines 53 in longitudinal force-transmitting relation between the truck frame and bolster 31, the effective level of such force-transmission being at the level of the convergence of the axial projections of links 53, i.e., at rail level.

For limiting movements of bolster 31 longitudinally of the truck frame and thus transmitting longitudinal forces between the truck frame and bolster in the event the traction linkages should become inoperative, upstanding safety stop abutments 84 are formed on the upper surfaces of the truck frame side members 7 in longitudinally spaced opposed relation with the respective bolster end members 35 and 37.

Operation of the truck is as follows: As motors M2, M3 and M4 drive axels 2, 3 and 4 respectively through gear boxes G2, G3 and G4, since their reaction connections to intermediate transoms 13, 15 and end transom 11, respectively, are in the same direction from the respective axles, the motor reactions will tend to raise or lower the entire truck frame simultaneously depending upon direction of operation and will thus produce no axle-to-axle load transference.

Because of the convergence of traction links 53 substantially at rail level and because the bolster is vertically rigid and longitudinally fixed with respect to underframe U, the effective level of longitudinal force transmission from the truck to underframe U via traction links 53 and the bolster will be at the same level, thus eliminating any vertical moment arm about which traction forces generated between the wheels and rail surfaces would otherwise act to transfer load from axle to axle. When bolster supporting springs 29 are compressed, left hand traction link 53 causes left hand bell crank 61 to pivot counterclockwise about its fulcrum 65 and right hand traction link 53 causes right bell crank 63 to pivot clockwise about its fulcrum 67, both bell cranks pivoting in unison in opposite rotational directions by virtue of their connection to each other by link 79. Thus irrespective of the extent to which springs 79 are compressed, links 53 are constantly in longitudinal force-transmitting relation between the truck frame and bolster 31. During lateral movement of bolster 31 and underframe U with respect to the truck frame as are permitted by shear deflection in elastomeric pads 23, irrespective of the transverse direction, the bell cranks 61 and 63 are pivoted respectively in clockwise and counterclockwise directions but constantly maintain traction links 53 in longitudinal force-transmitting relation between the truck frame and bolster 31.

The details of the construction may be varied substantially without departing from the spirit of the invention and the exclusive use of such modifications as come within the scope of the appended claims in contemplated.

I claim:

1. In a railway locomotive truck, at least two wheeled axles spaced apart longitudinally of the truck, a truck frame resiliently supported from said axles and having longitudinally extending side members arched over said axles and depressed therebetween, upright springs supported on the depressed portions of said side members outboard thereof, a bolster carried on said springs and having transverse structure overlying the depressed portions of said frame side members and its sides positioned transversely outwardly of said truck frame side members, upwardly facing bearing surfaces on said bolster spaced apart lengthwise of the truck and adapted for engagement with opposed downwardly facing bearings on a supported locomotive underframe, vertical axis pivot forming means on said bolster transverse structure adapted for mating engagement with corresponding means on a supported locomotive underframe, and a traction connection at each side of the truck between said truck frame side members and said bolster sides comprising a pair of longitudinally upwardly and outwardly inclined links connected at their lower ends to the respective truck frame side member and at their upper ends to the corresponding side of the bolster such that their axial projections intersect substantially at track level, said upwardly facing bearing surfaces being substantially in vertical alignment with said springs thereby permitting said bolster transverse structure to be sufficiently shallow to vertically clear said frame side members and said bolster sides to be sufficiently shallow to vertically clear the connections of said links to said truck frame side members during maximum compression of said springs.

2. In a railway locomotive truck according to claim 1, the connection of said links to said truck frame comprising a pair of bell cranks fulcrummed to the truck frame side member on transverse axes spaced apart longitudinally of the truck and having substantially horizontal arms extending toward each other and connected to each other by a substantially vertical link, and other arms extending substantially normal to the axes of the respective inclined links and being pivotally connected thereto.

3. In a railway locomotive truck according to claim 2, said truck frame side members having outwardly extending brackets supporting said upright springs and said bolster extending transversely outboard of said truck frame side members for support on said upright springs outboard of said frame side members.

4. A railway locomotive truck according to claim 3, wherein said bell cranks and links are positioned entirely outboard of said frame side members.

5. In a railway locomotive truck according to claim 4, said truck having three axles including two end axles and an intermediate axle, said truck frame having transversely extending transom members connecting said side members respectively intermediate said axles and at least at one end outboard of one of said axles, traction motors respectively drivingly connected to each of said axles and having reaction connections to said frame by means of said intermediate transoms and said end transom, said bolster comprising longitudinally extending side members and transversely extending end members connecting said side members, said bolster side members being disposed transversely outboard of said truck frame side members and said bolster end members respectively overlying, at least in part, the respective intermediate truck frame transoms, whereby said bolster end members and the portions of said frame side members define an opening substantially commensurate with the space defined by said intermediate transom members and said frame side members.

6. In a railway locomotive truck according to claim 5, there being four of said upwardly facing horizontal bearing surfaces including a pair on each bolster side member, said upright springs being spaced apart longitudinally of the truck substantially the same distance as said upwardly facing bearing surfaces and in substantial vertical alignment therewith.

7. In a railway locomotive truck according to claim 6, the fulcrums of said bell cranks being symmetrically disposed longitudinally of the truck with respect to said intermediate axle, said bolster side members having depending brackets at their ends, the upper ends of said links being pivotally connected respectively to said depending brackets.

8. In a railway locomotive truck according to claim 6, a central longitudinally extending tie member of shallow depth connecting said bolster end members and including said vertial axis pivot forming means.

9. In a railway locomotive truck according to claim 8, said pivot forming means comprising a vertical axis recess substantially at the center of said longitudinally extending tie member and adapted for mating engagement with a cylindrical boss on a supported locomotive underframe.

10. In a railway locomotive truck according to claim 9, said tie member being partly arched to provide necessary clearance above the middle axle traction motor.

* * * * *